United States Patent [19]

Foster

[11] Patent Number: 4,886,177

[45] Date of Patent: Dec. 12, 1989

[54] CAP FOR TUBES

[75] Inventor: Kevin D. Foster, Atlanta, Ga.

[73] Assignee: Porex Technologies Corp. of Georgia, Fairburn, Ga.

[21] Appl. No.: 264,898

[22] Filed: Oct. 31, 1988

[51] Int. Cl.[4] ..... B65D 41/20

[52] U.S. Cl. ..... 215/247; 53/471; 53/485; 53/489; 215/319; 220/287

[58] Field of Search ..... 215/247, 248, 249, 319, 215/DIG. 3; 220/287; 53/471, 485, 489

[56] References Cited

U.S. PATENT DOCUMENTS

| | | | |
|---|---|---|---|
| 893,469 | 7/1908 | Essmuller . | |
| 3,019,932 | 2/1962 | Singiser | 215/319 |
| 3,317,069 | 5/1967 | Chin | 215/319 X |
| 3,655,089 | 4/1972 | Tower | 215/100.5 |
| 3,807,457 | 4/1974 | Logsdon | 220/287 |
| 3,898,046 | 8/1975 | Ikeda et al. | 215/355 X |
| 4,008,820 | 2/1977 | Ruetz | 215/256 |
| 4,227,620 | 10/1980 | Conway | 215/355 |

FOREIGN PATENT DOCUMENTS

| | | | |
|---|---|---|---|
| 1316575 | 5/1973 | United Kingdom | 215/247 |
| 1507453 | 4/1978 | United Kingdom | 215/319 |

*Primary Examiner*—Donald F. Norton
*Attorney, Agent, or Firm*—Lane and Aitken

[57] ABSTRACT

A cap for sealing evacuated tubes has a plurality of sealing surfaces to seal tubes of various sizes and a septum of self-closing material to permit a needle to pass for the withdrawal or injection of fluids. The sealing surfaces are defined by a plurality of annular bands extending in series from a top wall, as well as a skirt which depends from the top wall and surrounds the annular bands.

12 Claims, 1 Drawing Sheet

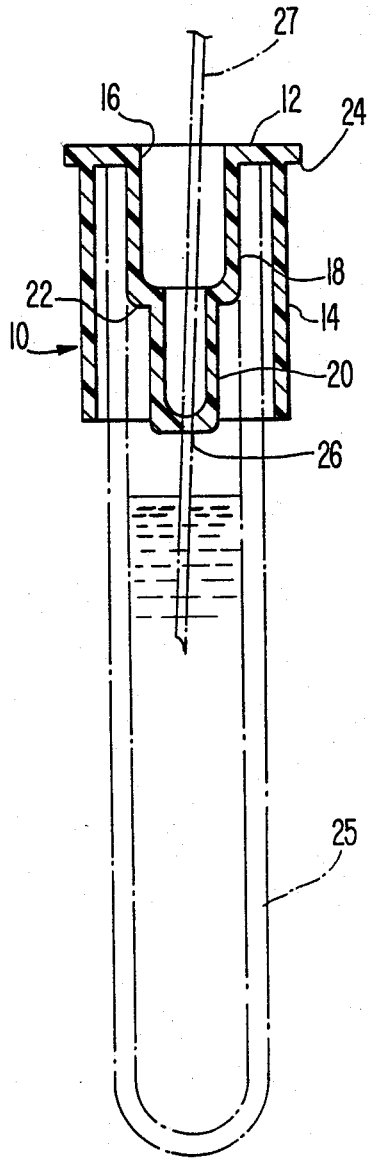
27
16
12
24
18
22
14
10
20
26
25

CAP FOR TUBES

BACKGROUND OF THE INVENTION

The present invention relates to container closures and, more particularly, to caps for tubes, and especially evacuated tubes.

Approximately 15 percent of the time, evacuated blood drawing tubes must be resealed for storage, centrifugation, refrigeration or freezing. In addition to blood drawing tubes, there are other tubes of various sizes commonly used in the laboratory which require closing. Three currently used methods for resealing blood drawing tubes and other tubes involve corks, plastic films and off-the-shelf closures. Corks do not form a tight seal, and since blood collection tubes come in several sizes, it is necessary to stock a variety of sizes of corks. Plastic films tear easily, shrink when frozen and are difficult to manage when it is necessary to work again with the sample in the tube. Other commercially available closures can and do pop off during centrifugation and other procedures, thereby posing a possible source of contamination which presents a danger to health care workers and other laboratory personnel.

SUMMARY OF THE INVENTION

By the present invention, a cap is provided which tightly seals tubes of various sizes. The cap is strong, durable, and not subject to significant changes in dimension in response to changes in temperature. In addition, it permits the fluid contained in a tube to be withdrawn for testing or other purposes without the opening of the tube and the associated exposure of laboratory personnel to possible contamination.

In order to provide the advantages described above, the cap according to the present invention includes a plurality of surfaces having different dimensions so that the cap tightly seals tubes of different diameters. The surfaces include a plurality of annular bands extending serially from a top wall of the cap and a skirt surrounding the bands. In addition, the cap includes a thin transverse wall which defines a septum for allowing a needle, either on automatic testing equipment or a hand-held syringe, to puncture the septum and withdraw fluid. The cap is of a resilient material which causes the hole in the septum caused by the needle to close itself when the needle is withdrawn.

BRIEF DESCRIPTION OF THE DRAWING

The drawing FIGURE is a cross-section through the cap according to the present invention, shown in a sealing position on a test tube, with a needle piercing the cap.

DETAILED DESCRIPTION OF THE PREFERRED EMBODIMENT

As can be seen from the drawing FIGURE, the cap according to the present invention, which is designated generally by the reference numeral 10, includes a top wall 12, an annular skirt 14 depending from the top wall 12, slightly inward from the outer periphery of the top wall 12, a central opening 16 in the top wall 12, and two annular bands 18 and 20 projecting down in series from the top wall 12 around the opening 16. The band 18, which is closer to the top wall 12, has a larger outer diameter than the band 20, and a shoulder 22 connects the bands 18 and 20. An external shoulder 24 is defined by the underside of the top wall 12 between the annular skirt 14 and the outer periphery of the top wall 12. The annular skirt 14 extends to a point about the same distance from the top wall 12 as the distal end of the band 20, the annular skirt 14 surrounding the bands 18 and 20. The top wall 12 is preferably circular, and the depending annular skirt 14 and the bands 18 and 20 are preferably cylindrical so that the cap seals tightly with evacuation tubes, such as the tube 25, and with other types of tubes, most of which are cylindrical. However, it is understood that the above-mentioned parts can be made in other configurations to seal tightly with tubes having non-circular cross-sections.

A transverse wall 26 is formed at the end of the band 20 which is distal to the top wall 12. In order that fluid samples may be taken from the tube 25 sealed by the cap 10, the transverse wall is made of an elastic material which will allow a needle 27 to pierce it for withdrawing a sample of the fluid in the tube 25 and will seal itself upon the withdrawal of the needle. Such elastic materials are known in the art. A thickness of between 0.025 and 0.100 inches is sufficient to permit the transverse wall 26 to close holes formed by needles of conventional sizes, while being thin enough to allow the needles to pierce the transverse wall easily. Preferably, the entire cap 10 is made of the same elastic material in a one-piece construction.

It can be appreciated that the band 20 remote from the top wall 12 can seal a tube of a first diameter by a tight frictional fit between the outer surface of the band 20 and the inner surface of the tube. In addition, the shoulder 22 engages the rim of the tube when the cap is fully inserted in the tube. The outer surface of the band 18 adjacent to the top wall 12 similarly seals against the inner wall of the tube having a larger diameter, and the underside of the top wall 12 seals against the rim of the tube when the cap is fully inserted. Furthermore, the radial distance between the band 18 and the annular skirt 14 is greater than the thickness of the tube wall, so that the annular skirt 14 does not seal against the outer surface of the tube, but instead would engage and seal against the outer surface of a tube of yet another diameter. The rim of such another tube will simultaneously be sealed by the underside of the top wall 12.

As an alternative, the radial distance between the outer surface of the band 18 and the inner surface of the annular skirt 14 can be made so that the inner wall of the annular skirt 14 seals against the outer surface of the tube when the inner surface and rim of the tube are sealed, respectively, by the band 18 and the underside of the top wall 12. The outer diameters of the bands 18 and 20 and the inner diameter of the annular skirt 14 can be chosen so that each seals with a tube of a standard size commonly used in laboratory work.

In use, the cap 10 is placed over the end of any one of a plurality of tubes of various sizes so that at least one of the sealing surfaces of the cap, such as the band 18, the band 20, and the inner surface of the skirt 4, engages and seals the tube against the egress or ingress of fluid. The transverse wall 26 is pierced by the needle 27, which forms a hole in the resilient material as it goes through. Fluid is withdrawn from the tube 10 or injected into the tube, as desired, through the needle 27. When the fluid flow is completed, the needle 27 is withdrawn from the transverse wall 26, whereupon the resilient material closes the hole formed in it by the needle.

Although the cap 10 illustrated in the drawing FIGURE includes only two annular bands, it is contemplated that embodiments including three or more bands can be constructed, in which each successive band projecting away from the top wall 12 has a smaller outer diameter than the preceding one. In addition, the band farthest from the top wall 12 will include a transverse wall which acts as a septum to be punctured by a needle, such as that of automatic testing equipment or a hand-held syringe.

Other modifications, changes and substitutions are intended in the foregoing disclosure. Accordingly, it is appropriate that the appended claims be construed broadly and in a manner consistent with the spirit and scope of the invention disclosed herein.

I claim:

1. A cap for sealing tubes of various sizes and permitting the withdrawal of fluids therefrom, comprising:

a top wall having an opening therein;

a plurality of bands projecting serially from the top wall; and a skirt depending from the top wall and surrounding the bands, wherein the bands include a first band adjacent to said top wall and having a first outer perimeter, and a second band depending from said first band and having a second outer perimeter smaller than first outer perimeter, and a transverse wall extending across said second band, said transverse wall being made of an elastic material defining means for resealing itself in response to puncturing by and removal of a needle.

2. The cap according to claim 1, wherein said first band is connected to said second band by a shoulder.

3. The cap according to claim 1, wherein said first and second bands are circular.

4. The cap according to claim 3, wherein said first and second bands are concentric with the opening in said top wall.

5. The cap according to claim 1, wherein the cap is made of one piece.

6. The cap according to claim 1, wherein said transverse wall has a thickness of between 0.025 and 0.100 inches.

7. The cap according to claim 1, wherein said skirt defines an axis and an end axially spaced from said top wall, said skirt terminating at said end.

8. The cap according to claim 1, wherein said skirt is cylindrical.

9. The cap according to claim 1, wherein said top wall has an outer periphery at least as great as any outer periphery of said skirt.

10. A method of sealing tubes of various sizes while permitting withdrawal of fluid from and injection of fluid into said tubes, comprising:

providing a cap having a plurality of sealing surfaces of different dimensions and a septum of resilient material capable of closing a hole formed in it by a needle;

placing said cap over an end of a tube of any of said various sizes such that at least one of said sealing surfaces seals the tube against the egress or ingress of fluid;

piercing said septum with a needle;

withdrawing fluid from or injecting fluid into said tube through said needle; and removing said needle to allow the resilient material to close the hole formed by the needle.

11. A cap for sealing tubes of various sizes and permitting the withdrawal of fluids therefrom, comprising:

a top wall having an opening therein and an outer periphery;

a plurality of bands projecting serially from the top wall;

a skirt depending from the top wall inside said outer periphery and surrounding the bands; and a shoulder defined between said skirt and said outer periphery of said top wall;

wherein the bands include a first band adjacent to said top wall and having a first outer perimeter, and a second band depending from said first band and having a second outer perimeter smaller than said first outer perimeter, and a transverse wall extending across said second band, said transverse wall being made of an elastic material defining means for resealing itself in response to puncturing by and removal of a needle.

12. A cap for sealing tubes of various sizes and permitting the withdrawal of fluids therefrom, comprising:

a top wall having an opening therein;

a plurality of bands projecting serially from the top wall; and a skirt depending from the top wall to a point spaced from the top wall a distance substantially equal to the distance between the top wall and a distal end of said second band, said skirt surrounding the bands, wherein the bands include a first band adjacent to the top wall and having a first outer perimeter, and a second band depending from said first band and having a second outer perimeter smaller than first outer perimeter, and a transverse wall extending across said second band, said transverse wall being made of an elastic material defining means for resealing itself in response to puncturing by and removal of a needle.

* * * * *